United States Patent [19]

Scheiber et al.

[11] 4,258,505

[45] Mar. 31, 1981

[54] METHOD OF AND APPARATUS FOR THE SURFACE CLEANING OF WORKPIECES

[75] Inventors: Werner Scheiber, Frankfurt am Main; Per O. Aalrust, Darmstadt, both of Fed. Rep. of Germany

[73] Assignee: Metallgesellschaft Aktiengesellschaft, Frankfurt am Main, Fed. Rep. of Germany

[21] Appl. No.: 17,036

[22] Filed: Mar. 2, 1979

[30] Foreign Application Priority Data

Mar. 4, 1978 [DE] Fed. Rep. of Germany ..... 2809376
Feb. 7, 1979 [DE] Fed. Rep. of Germany ..... 2904551

[51] Int. Cl.[3] ..... B24B 17/00; B24B 1/00

[52] U.S. Cl. ..... 51/7; 51/20; 51/317; 51/DIG. 10

[58] Field of Search ..... 51/7, 17–20, 51/317, 425, 428, DIG. 10

[56] References Cited

U.S. PATENT DOCUMENTS 801,403 10/1905 Rupley ..... 51/20
3,307,296 3/1967 Ashworth ..... 51/425 X

FOREIGN PATENT DOCUMENTS 1167689 4/1964 Fed. Rep. of Germany ..... 51/7
540726 1/1977 U.S.S.R. ..... 51/7

*Primary Examiner*—Gary L. Smith
*Attorney, Agent, or Firm*—Karl F. Ross

[57] ABSTRACT

A method of and apparatus for the surface cleaning of workpieces, e.g. the degreasing, scale-removal and rust removal from a metallic surface, especially so as to produce a bright, clean and relatively smooth surface to receive a coating, positions the workpiece in a fluidized bed of an abrasive, such as particle of corundum or quartz sand, and directs fine jets of gas at the surface from nozzles spaced therefrom within the fluidized bed.

5 Claims, 6 Drawing Figures

METHOD OF AND APPARATUS FOR THE SURFACE CLEANING OF WORKPIECES

FIELD OF THE INVENTION

The present invention relates to a method of and to an apparatus for the cleaning of workpiece surfaces with abrasive particles and, more particularly, to a method of and an apparatus for a surface treatment of such workpieces with abrasives such as corundum or quartz sand which will result in a simultaneous rust removal, descaling and degreasing of the surface. The invention is applicable to continuous processes and continuously operating apparatus for such surface treatment and to the surface treatment of both continuous (elongated continuously displaceable) workpieces as well as to workpieces of limited length.

BACKGROUND OF THE INVENTION

Surfaces of workpieces, especially metallic workpieces, to be coated with paint, synthetic resins or other coating materials must be thoroughly cleaned in order to provide a satisfactory bonding between the coating and the substrate surface. While a particularly thorough cleaning, accompanied by grease removal, rust removal and descaling, can be effected by sand blasting, the entrainment of corundum or other abrasive particles in a gas stream against the surface, or the propulsion of steel grit at high speed and kinetic energy thereagainst, the conventional processes are not always satisfactory.

In most cases, the abrasive particles are projected against the surfaces to be cleaned by dry blasts of compressed air in cabins with the blasting turned on and off by a pedal-operated valve while a changeover from one abrasive to another can be effected by the use of a control handle connecting one or another dispenser or hopper containing the several abrasives to the sandblasting gun. Such systems are suitable for the cleaning of large parts and are not always applicable for the cleaning of small-diameter or small-cross-section continuous members such as rods, wires, tubing, pipe and similar structures.

In another conventional process, the abrasive particles receive their kinetic energy by being cast against the workpiece with blade wheels rotating at high speed. Such wheels can throw 100 to 200 kg of abrasive per minute at a velocity of 70 to 80 meters per second against the surfaces to be cleaned (see Metalloberfläche 23, 1969, pages 262–265).

For rapid descaling of tubes, a system is described in Metalloberfläche 22, 1968, pages 344 and 345, which comprises an evacuated head chamber and a head connected to an abrasive hopper. The abrasive flows uniformly out of the hopper by the action of the vacuum or suction produced in the head and is carried by compressed air through a plurality of nozzles into the chambers of the surface-treating unit.

In another process which has been employed for rapid cleaning of workpieces, a fluidized bed of sand is maintained by passing compressed air therethrough and residues upon the workpiece such as oils and greases, are volatilized at temperatures up to 450° C. The temperature of the bed can be held constant and the process operated automatically as described in Metalloberfläche 30, 1976, page 495.

While all of these processes have been satisfactory to a greater or lesser extent for specific workpieces, they have not been found to be totally successful for the treatment of continuous workpieces for various reasons. For example, the prior-art processes can give surfaces which are sufficiently clean, i.e. grease and scale are removed and rust is eliminated to the extent required by German Industrial Standard (DIN) 18,364 degree No. 3.

However, the roughening of the surface is limited at best and these processes have been found to provide only a moderate increase in the surface area as is required for effective bonding.

The conventional processes also have the disadvantage that they generate high noise amplitudes, create dust and occasionally release noxious or toxic materials into the environment. As a consequence, they are ecologically disadvantageous.

Furthermore, in the conventional systems, all parts contacted by the abrasive are subject to extremely heavy wear so that they are continuously destroyed, requiring maintenance and replacement of the hoses and blasting nozzles or the impellers of centrifugal apparatus in an overly frequent manner.

Those processes and apparatus which require a vacuum or an elevated temperature to be used have the further disadvantage that they must be continuously and precisely controlled, the control systems and personnel involving high cost.

OBJECTS OF THE INVENTION

It is the principal object of the present invention to provide a method of cleaning the surfaces of workpieces, especially metallic workpieces, so as to provide an extremely high effective surface area and high bonding characteristics for synthetic resins or coatings which may be subsequently applied.

Another object of the invention is to provide a method of cleaning the surfaces of metallic workpieces which avoids the disadvantages of the earlier systems and is especially quiet and free from environmental hazard.

Still another object of this invention is to provide an improved method of continuously surface cleaning endless workpieces such as tubes or wires, in such manner than the surface is descaled, derusted and degreased while being roughened to a highly desirable extent.

Yet a further object of this invention is to provide a method of the type described which reduces the need for complex control equipment and personnel, which is not prone to accelerated wear of essential parts, and which is more efficient in cleaning and roughening the surface than earlier systems.

It is also an object of the invention to provide a method for the purposes described, especially where the metallic workpiece is to be coated with a synthetic resin, a varnish or a metallic coating, which will achieve a large increase in the effective surface area while minimizing the peak-to-valley height ($H_{max}$).

Still another object of the invention is to provide an improved apparatus for carrying out the method of the present invention and attaining all of the method objects set forth above.

SUMMARY OF THE INVENTION

These objects and others which will become apparent hereinafter are attained, in accordance with the present invention, by positioning the metallic workpiece, whose surface is to be cleaned, in a fluidized bed of the abrasive particles and directing fine jets of gas at the surface, advantageously, from nozzles which are swept over the surface by relative movement of the workpiece and the nozzles and/or by surrounding the workpiece with an array of such nozzles.

According to the invention, therefore, the fine gas jets, prior to their emergence from the nozzles, do not entrain any abrasive particles and hence wear of the nozzles is minimized.

When the fine gas streams are directed against the surface from nozzles spaced therefrom within the fluidized bed and at high pressure, a vastly decreased depth of pitting is obtained with a remarkable increase in the surface area along with total removal of grease, rust and scale.

In accordance with the best mode embodiment of the invention, the endless workpiece, e.g. rod, tube or wire, is passed through the fluidized bed continuously within a closed vessel and past one or more arrays of nozzles which have their fine gas jets trained upon the surface as operated at high pressure. Preferably the nozzles are of angular configuration and completely surround the body.

While we have found that the fine gas jets at high pressure can be inert gases, such as nitrogen and the usual inert gases neon, argon and krypton, the process has been found to be effective with air as well. In fact, in the best mode embodiment of the invention air is used.

While we have mentioned the fact that the endless workpiece can be continuously moved through the fluidized bed, i.e. into and out of the latter while traversing the bed, it is also possible to carry out the invention upon other bodies of limited length, preferably prismatic and rotationally symmetrical bodies which can be supported immovably in the fluidized bed while the nozzles are shifted or is movable in the fluidized bed past the stationary nozzle. Naturally, a combination of movement of the nozzle and movement of the workpiece can also be used.

The apparatus of the present invention thus comprises a closed housing having a grate above which a fluidized bed is maintained and, in the case of the continuous treatment of endless workpieces, gates through which the workpiece is introduced and removed from the fluidized bed. A blower or compressed-air source is provided to feed the fluidizing gas into the chamber below the grate while a pressure conduit is connected to a compressor or other source of high-pressure gas and to the nozzles. Valves can be provided to control the flow of the gas in the conduit and the relative pressures of the gas in the fluidized bed and in the conduit, it being understood that the fluidized bed will always be under a pressure less than that ahead of the orifices or nozzle openings through which the fine streams of high-pressure gas emerge.

The chamber may be provided with a duct for conducting gas from the vessel, the duct preferably opening into a separator (e.g. a cyclone) from which the gas can be separated from the particles of abrasive. The cyclone can be provided with means for returning the particles to the fluidized bed, e.g. via a gate.

A further hopper or source of fine particles can be provided, preferably with a respective gate, or this source may be simply a source of a different type of abrasive while the fines are collected elsewhere before the gases are released into the environment.

When the apparatus of the invention is used to treat prismatic or rotationally symmetrical workpieces rather than continuous workpieces, the apparatus according to the invention can be provided with a holder for supporting the workpiece in the fluidized bed and means for rotating the workpiece relative to stationary nozzles and/or a carriage for traversing the nozzles along the workpiece or displacing the workpiece relative to the nozzles.

The method and apparatus of the invention have been found to be particularly advantageous because they give rise to a large increase in the surface area of the workpiece with only a small peak-to-valley distance (depth of pitting) while avoiding any disturbance of the environment by the generation of dust or the release thereof and by minimizing the noise output of the apparatus. It is also important to note that the complicated parts of earlier systems which are subjected to wear need not be subject to wear in the system of the present invention and, finally, that considerably less energy is used in the system of the present invention than in prior art arrangements.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
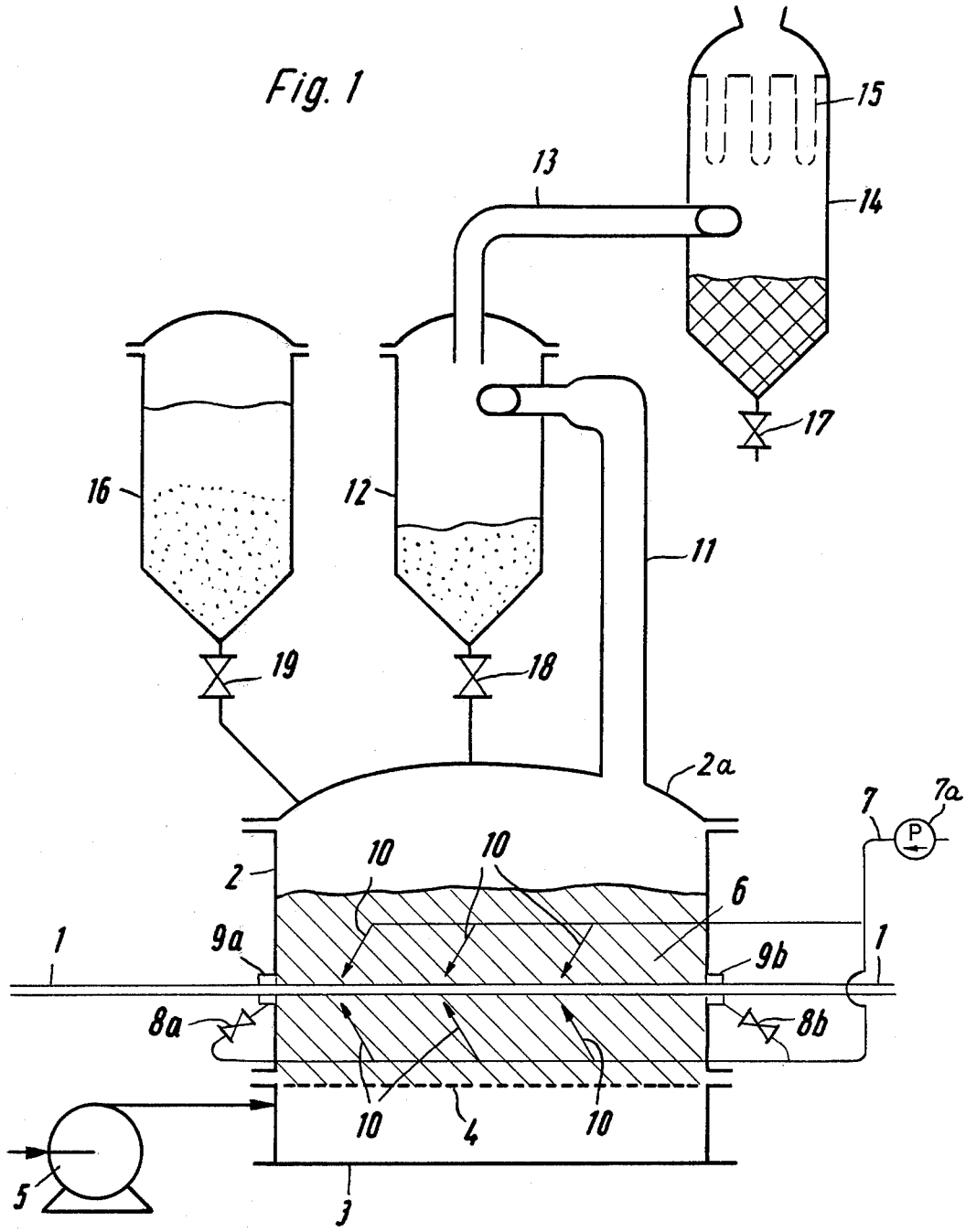
FIG. 1 is a flow diagram illustrating the method of the present invention as applied to the treatment of continuous workpieces.

The apparatus shown in FIG. 1 comprises a fluidizing vessel 2 having a removable cover **2*a* and formed with a grate 4 above a plenum chamber 3 into which compressed air is forced to maintain a bed 6 of abrasive particles in a fluid and agitated state. The gas introduced by the blower 5 is preferably air. The closed vessel 2 is formed with 2 lock chambers 9*a* and 9*b* through which the continuous workpiece 1 can be continuously moved by rollers or other means not shown. The workpiece 1** may arrive from a fabricating plant in which the workpiece, e.g. a steel tube, is formed and may be fed directly into an installation for coating the workpiece, e.g. by applying a synthetic-resin layer thereto.

The grate 4 may be formed by a support provided with a filter cloth covering or by a metal frit (i.e. a layer of porous sintered metal).

Figure 4:
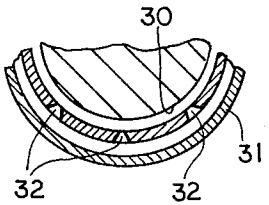
FIG. 4 is a detail view illustrating the nozzle arrangement and the workpiece surface.

The fluidized bed of abrasive 6 completely surrounds the workpiece 1 within the vessel. A pressure conduit 7, connected to a compressor **7*a*, leads into the vessel and communicates with annular nozzles 10 whose orifices are trained upon the workpiece surface. These nozzles are, as can be seen from FIG. 4, slightly spaced from the surface 30 of the workpiece and can be formed at 32, in the wall of an annular tube 31 constituting the nozzle structure 10 which has been represented only diagrammatically in FIG. 1**.

From the conduit 7 gases also form through pressure reducing valves 8*a* and 8*b* through the lock chambers 9*a* and 9*b* into the vessel 2 to prevent an escape of abrasive through these lock chambers and with the moving workpiece.

The gas, preferably air, is blown at high pressure against the workpiece and, in spite of the fact that it does not entrain particles out of its nozzles, had been found to pick up particles from the fluidized bed and propel them at high velocity against the surface.

The mixture of gas and abrasive which rises from the fluidized bed can be carried away through the exhaust duct 11 to the cyclone separator 12.

Coarse abrasive particles are recovered in the cyclone 12 and are recycled to the fluidizing vessel 2 by the lock chamber 18.

The gas and fine abrasive particles are then passed via 13 into a second cyclone separator 14 in which the fines are recovered. The gas is blown out of the cyclone 14 into the atmosphere through a plug or bag filter 15 incorporated in the upper portion of the cyclone 14. The fines collected at the bottom of the cyclone 14 are intermittently discharged through the valve 17. Spent abrasive in the fluidized bed can be discharged and replaced by fresh abrasive which is supplied from the abrasive-particle hopper 16 to the vessel 2 through the lock chamber 19.

Figure 2A:
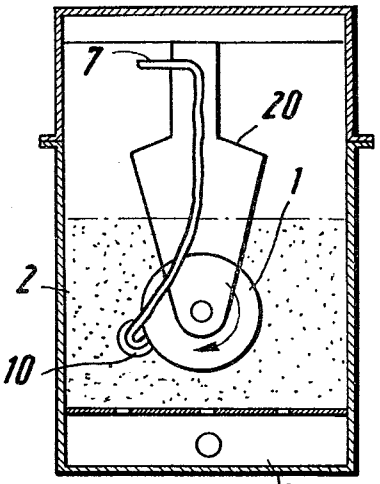
FIG. 2A is a cross section through the apparatus of FIG. 2.
Figure 2:
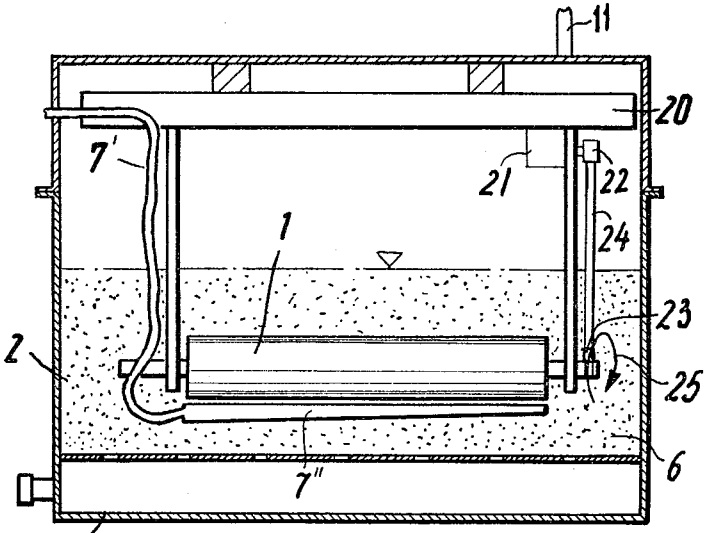
FIG. 2 is a diagram of a system used for the treatment of cylindrical workpieces.

In FIG. 2 we have shown the system in which a cylindrical workpiece of limited length, e.g. a roll as will be described below, is suspended from a holder 20 and is rotated by a motor 21 via the belt drive 22, 23, 24 in the sense of arrow 25 in the fluidized bed 6. The conduit 7' feeds an elongated nozzle 7'' form which jets of air are trained upon the surface of the workpiece. In this case, the nozzle assembly is stationary while the workpiece is rotated to sweep its surface past the nozzles. The system is shown in cross section in FIG. 2A.

Figure 3A:
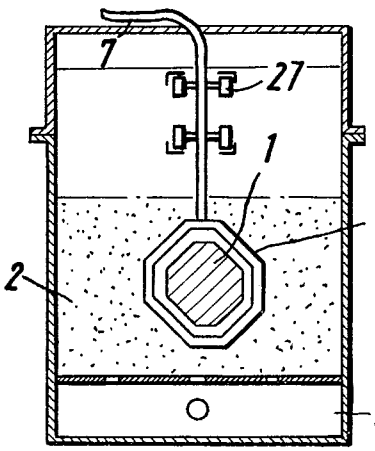
FIG. 3A is a cross sectional view through the apparatus of FIG. 3.
Figure 3:
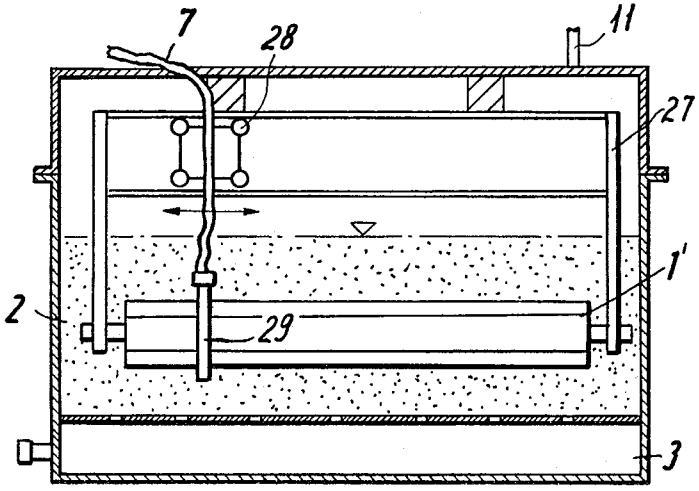
FIG. 3 is a view of another apparatus for carrying out the process of the present invention also in diagrammatic form.

FIG. 3 and FIG. 3A illustrate an embodiment of the invention in which a prismatic workpiece is subjected to surface treatment. In this case, the workpiece 1' can be held stationary in the holder 27 while a carriage 28 carries the annular nozzle assembly 29 to and for along the workpiece. The nozzle assembly 29 is connected to the high-pressure conduit 7 as previously described.

SPECIFIC EXAMPLES

EXAMPLE 1

Steel tubing of an internal diameter of 16 mm and a wall thickness of 1.5 mm in accordance with German Industrial Standard (DIN) 2,394 is made continuously from deformable steel strip in a tube welding machine at a speed of 100 m/min. and is fed at this speed as the continuous workpiece through an apparatus of the type shown in FIG. 1. The vessel contains abrasive corundum powder having a particle size of 0.2 mm. Compressed air at a pressure of 7 bars is forced in fine jets against the surface of the workpiece 1 across a distance of 15 mm through the fluidized bed from six nozzles 10 with orifices 0.5 mm in diameter and surrounding the workpiece. The treatment was found to give a surface free from scale and grease and conforming to derusting degree No. 3 of German Industrial Standard (DIN) 18,364. The average peak-to-valley dimension was 0.004 mm and the surface area was found to have been increased 42 times. No dust escaped and the noise level was 20dB(a) at a distance of 1 m from the apparatus. 12 $m^3$ of compressed air were used per hour.

CONTROL EXAMPLE A

The steel tubing described in Example 1 was displaced at the same rate through a chamber in which the abrasive consisted of comminuted piano wire having a particle size of 0.8 mm and was thrown by four impellers against the workpiece. All other conditions were the same. The resulting surface was free from scaling grease and conformed to derusting degree No. 3 of German Industrial Standard (DIN) 18,364. The surface had a mean peak-to-valley distance of 0.055 mm and the surface area was increased 18 times. The noise at a distance of 1 m was 96dB(a).

CONTROL EXAMPLE B

The steel tubing of Example 1 was moved through a blasting chamber and subjected to blasting therein with corundum having a particle size of 0.8 mm from four blasting nozzles, the corundum being entrained in a gas from the nozzles at a pressure of 7 bar. The resulting surface was free from scaling grease and conformed to derusting degree No. 3 German Industrial Standard (DIN) 18,364. The mean peak-to-valley distance was 0.04 mm and the surface area was increased 25 times. The noise level was 104dB(a) at a distance of 1 m from the workpiece. 500 $m^3$ of compressed air were used per hour and considerable dust was emitted into the atmosphere, presumably because of the high volume of compressed air used.

EXAMPLE 2

Using the apparatus of FIG. 2, a rotationally symmetrical workpiece, namely a printing machine roller of the type used as an ink-applying cylinder in offset printing presses, was fixed in the holder 20 and is rotated at constant speed. Compressed air from the duct 7 is blown through the nozzle which has a slot orifice extending the full length of the roll. Here again the peak-to-valley distance corresponded to that obtained in Example 1 and a similar improvement in the surface area was recognized.

EXAMPLE 3

A prismatic body as shown in FIGS. 3 and 3A was fixed in the holder 27 and the compressed air was supplied to a single annular nozzle 10 which was moved along the workpiece by the carriage. The results of the blasting treatment were similar to those obtained in Example 1.

We claim:

1. A process for the surface treatment of a workpiece to effect degreasing, derusting or descaling thereof, which comprises:

(a) disposing the workpiece in a fluidized bed of particles of an abrasive selected from the group which consists of corundum or quartz sand;

(b) fluidizing the bed from below by air; and (c) while fluidizing the bed and independently thereof, directing against said surface fine gas streams of air at high pressure from nozzles in annular array spaced from the surface of the workpiece and surrounding same whereby the streams upon emergence from said nozzles entrain particles of the bed against said surface.

2. The process defined in claim 1 wherein said workpiece is continuous and is moved continuously through said bed past said nozzle array.

3. The process defined in claim 1 wherein said workpiece is elongated and is held in said fluidized bed, further comprising the step of relatively displacing said nozzles and said workpiece.

4. An apparatus for the surface cleaning of a workpiece comprising:

(a) a closed fluidizing vessel having a bottom chamber and a perforated wall above said bottom chamber and fluidized bed chamber;

(b) a blower communicating with said bottom chamber for feeding a fluidizing gas thereto for fluidize a bed of abrasive particles in said fluidizing chamber;

(c) means for positioning a workpiece in the fluidized bed in said fluidizing chamber;

(d) means for feeding abrasive particles to said fluidizing chamber;

(e) a plurality of nozzles in an array surrounding and trained upon said workpiece while being spaced therefrom within said fluidized bed;

(f) a source of high-pressure gas connected to said nozzles;

(g) an exhaust conduit leading from said vessel for carrying away gas and entrained particles;

(h) means connecting said exhaust conduit to a first cyclone for removing coarse particles from the gas traversing said exhaust conduit;

(i) means for recycling particles from said first cyclone to said fluidizing chamber;

(k) a second cyclone connected to said first cyclone for recovering fine particles from the gas traversing said exhaust conduit; and (l) a supply bin containing fresh abrasive and connected by a lock chamber to said fluidizing vessel.

5. The apparatus defined in claim 4 wherein said fluidizing chamber is provided on opposite sides with lock chambers through which said workpiece is continuously fed.

* * * * *